US008713767B2

(12) United States Patent
Massotte et al.

(10) Patent No.: US 8,713,767 B2
(45) Date of Patent: May 6, 2014

(54) PROCESS AND DEVICE FOR TEXTURING YARNS FOR RUGS OR CARPET UPSTREAM OF A HEAT TREATMENT UNIT

(75) Inventors: Philippe Massotte, Gueberschwihr (FR); Didier Thibault, Bru (FR)

(73) Assignee: Superba, Mulhouse (FR)

( * ) Notice: Subject to any disclaimer, the term of this patent is extended or adjusted under 35 U.S.C. 154(b) by 327 days.

(21) Appl. No.: 13/178,529

(22) Filed: Jul. 8, 2011

(65) Prior Publication Data

US 2012/0018916 A1 Jan. 26, 2012

(30) Foreign Application Priority Data

Jul. 26, 2010 (FR) ..... 10 56097

(51) Int. Cl.
*D02G 1/20* (2006.01)

(52) U.S. Cl.
USPC ..... 28/221; 28/247; 28/258

(58) Field of Classification Search
USPC ..... 28/247, 248, 250, 256, 257, 258, 220, 28/266, 271, 221, 277, 281, 218, 262, 263, 28/273, 274, 276; 264/168, 167
See application file for complete search history.

(56) References Cited

U.S. PATENT DOCUMENTS

| | | | | |
|---|---|---|---|---|
| 2,875,503 | A * | 3/1959 | Frickert et al. | 428/222 |
| 3,102,322 | A | 9/1963 | Whitaker | |
| 3,166,820 | A * | 1/1965 | Taul et al. | 28/266 |
| 3,255,064 | A * | 6/1966 | Makansi | 156/166 |
| 3,341,911 | A * | 9/1967 | Smith | 28/266 |
| 3,389,445 | A * | 6/1968 | Schreffler | 28/256 |
| 3,471,911 | A * | 10/1969 | Nechvatal et al. | 28/257 |
| 3,667,094 | A * | 6/1972 | Yazawa | 28/266 |
| 3,672,819 | A * | 6/1972 | Katsuyama et al. | 8/137 |
| 3,697,637 | A * | 10/1972 | Kawai et al. | 264/168 |
| 4,005,569 | A * | 2/1977 | Corbiere | 57/246 |
| 4,297,412 | A * | 10/1981 | Achard et al. | 428/370 |
| 4,347,203 | A * | 8/1982 | Mimura et al. | 264/41 |
| 4,834,838 | A * | 5/1989 | Klowak | 162/109 |
| 5,653,010 | A * | 8/1997 | Grossenbacher et al. | 28/256 |
| 6,481,072 | B1 * | 11/2002 | Hoover et al. | 28/263 |
| 7,228,604 | B2 | 6/2007 | Hoover | |
| 7,500,295 | B2 * | 3/2009 | Laird et al. | 28/220 |
| 8,096,029 | B2 * | 1/2012 | Lanz et al. | 28/266 |

(Continued)

FOREIGN PATENT DOCUMENTS

| | | |
|---|---|---|
| EP | 1323853 | 7/2003 |
| FR | 2359912 | 2/1978 |

OTHER PUBLICATIONS

Search Report and Written Opinion dated Mar. 28, 2011 in priority Application No. FR1056097.

*Primary Examiner* — Amy Vanatta
(74) *Attorney, Agent, or Firm* — Kilpatrick Townsend & Stockton LLP; Renae Bailey Wainwright; Dean W. Russell

(57) ABSTRACT

The present invention relates to a process and a device for texturing yarns for rugs or carpet, upstream of a heat treatment unit.

Process characterized in that it consists essentially of or comprises making, downstream of a rack, on at least one yarn, at least one microtexturing operation using a microtexturing machine, then depositing the yarn obtained at the outlet of the microtexturing machine, in bulk or in loops, in a free state, onto an intermediate device for accumulation and transport, carrying the yarn obtained to a downstream heat treatment unit.

14 Claims, 1 Drawing Sheet

(56) References Cited

U.S. PATENT DOCUMENTS

2001/0009053 A1* 7/2001 Bartkowiak et al. ..... 28/276
2002/0121011 A1* 9/2002 Rasnick et al. ..... 28/258
2003/0110754 A1* 6/2003 Simmen ..... 57/289
2007/0084180 A1* 4/2007 Hoover ..... 57/200
2008/0301922 A1 12/2008 Hoover

* cited by examiner

PROCESS AND DEVICE FOR TEXTURING YARNS FOR RUGS OR CARPET UPSTREAM OF A HEAT TREATMENT UNIT

CROSS-REFERENCE TO RELATED APPLICATION

This application claims priority to French Patent Application No. 10 56097 filed on Jul. 26, 2010, the contents of which are incorporated herein by reference.

BACKGROUND

The present invention relates to the field of the textile industry, in particular the processing of yarns for rugs or carpet upstream of a heat treatment unit and a process for texturing yarns for rugs or carpet, upstream of a heat treatment unit.

The invention also relates to a device for implementing this process.

Texturing yarns prior to heat treatment is an operation that is commonly performed and usually involves a modification of a yarn originating from spinning to give it different properties from the original ones, namely an increase in its volume, a change in its appearance or its tactile features.

For this purpose, we know, from FR-A-2 359 912, a texturing nozzle of one or more yarns consisting of synthetic filaments, for obtaining, at the outlet of the nozzle, a yarn with a silky hand comparable to that of a wool yarn, this yarn being taken over, at the outlet of the nozzle, under tension, for fixing heat treatment by continuous passage in a heat setting or similar machine. The texturing thus obtained consequently allows making yarns for furniture or textiles with an appearance similar to that of wool.

There are also known yarn crimping methods, which consists of leading the yarns between two feed rollers that force said yarns into a compacting channel. This compacting channel, called crimping box, is usually equipped at its opposite end to the rollers with a check valve to ensure compaction of the yarns inside said crimping box. It results, by increasing the friction of the fibers or yarns on the walls of the compacting box, that the material that must be curled will lose, at the outlet of the feed rollers, their longitudinal presentation, in order to take on a crimped presentation generated by the downstream friction of the yarns on the walls of the crimping box. This crimping is made permanent by a subsequent heat fixing treatment, after deposition of the crimped yarns, in a loop on a conveyor belt moving in fixation machines by steaming or otherwise. The yarns leaving the processing machine present with a significant change in appearance, mainly due to the permanent crimp given to them. Such crimped yarns are more particularly suitable for making tufted rugs or carpets.

BRIEF SUMMARY

The present invention relates to a process for texturing yarns for rugs or carpet, upstream from a heat treatment unit, which allows changing the characteristics of the yarns used in this field and obtaining a substantial productivity gain.

For this purpose, the process according to the invention is characterized in that it consists essentially of or comprises making, downstream from a rack, on at least one yarn, at least one microtexturing operation using a microtexturing machine, then of depositing the yarn obtained at the outlet of the microtexturing machine, in bulk or in loops, in a free state, onto an intermediate device for accumulation and transport, routing the yarn obtained to a downstream heat treatment unit.

The invention also concerns a device for carrying out this process, characterized in that it consists of or comprises at least one microtexturing machine, mounted downstream from a rack and whose outlet delivers the yarn obtained, in a free state, onto an intermediate device for accumulation and transport of the yarns to a downstream heat treatment unit.

BRIEF DESCRIPTION OF THE DRAWINGS

The invention will be better understood from the description below, which relates to preferred embodiments, given as non-limiting examples and explained with reference to the accompanying drawing, in which.

DETAILED DESCRIPTION

Figure 1:
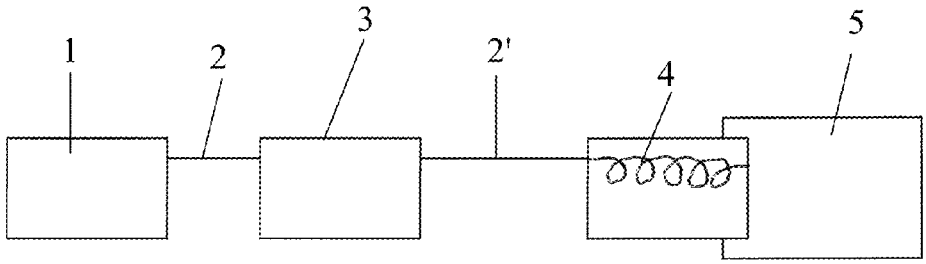
FIG. 1 is a schematic view of a device for carrying out the process according to the invention.

As shown, as an example, in FIG. 1 of the enclosed drawings, the texturing process of the yarns for rugs or carpet, upstream from a heat treatment unit, according to the invention, consists essentially of or comprises making, downstream from a rack 1, on at least one yarn 2, at least one microtexturing operation using a microtexturing machine 3, then depositing the resulting yarn 2' at the outlet of the microtexturing machine 3, in bulk or in loops, in a free state, onto an intermediate device 4 for accumulation and transport, routing the yarn obtained to a downstream heat treatment unit 5.

For this purpose, the device for the implementation of this process consists of or comprises at least one microtexturing machine 3, mounted downstream of a rack 1, and whose outlet delivers the yarn obtained 2', in a free state, onto an intermediate device 4 for accumulation and transport of the yarn to a downstream heat treatment unit 5.

The implementation of the process according to the invention allows changing the texture of the yarn or yarns 2 entering the microtexturing machine 3, which causes, on the one hand, a modified layout of its fibers in the sense of a swelling of the yarn and, on the other hand, a modification of the tactile aspect of the yarn or yarns obtained 2'. Because these yarns are deposited on the intermediate device 4 for accumulation and transport in a free state, i.e. without tension, the swelling obtained during treatment by microtexturing in the machine 3 is completely preserved, and a significant increase in volume can be seen. The heat treatment done in the downstream heat treatment unit 5 then allows making the result obtained permanent, namely to deliver, at the outlet, a yarn or yarns 2' with a much larger section and a tactile aspect different from the entering yarns 2.

Conversely, in the known microtexturing treatments, tension is applied to the yarn during the entire treatment, so that a partial retraction of the yarn in the sense of its initial section is immediately induced, and only the tactile aspect remains perceptible after heat treatment.

Figure 2:
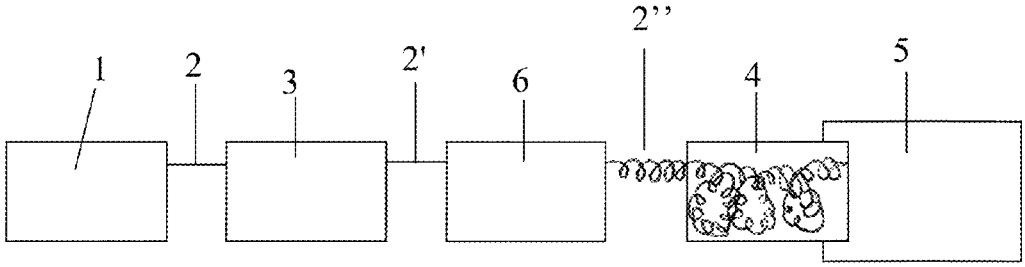
FIG. 2 is a view similar to that in FIG. 1 for an alternative embodiment of the invention.

It is also possible, according to an alternative embodiment of the invention, shown in FIG. 2 of the enclosed drawings, to perform on a yarn or yarns 2', at the outlet of the microtexturing machine 3 and before their deposit, in a free state, on the intermediate device 4 for accumulation and transport, a crimping operation of said yarns 2' in a crimping machine or crimping box 6. For this purpose, the device according to the invention is completed by a crimping machine or a box 6 inserted downstream from the microtexturing machine 3 and upstream from the intermediate device 4 for accumulation and transport of the crimped yarn or yarns 2" towards a downstream heat treatment unit 5.

Such a crimping machine or crimping box 6 allows obtaining regular crimping at its outlet and is of a known type. Thus, such machine or box may be especially of the type known from EP 1 323 853 B1 and appear mainly in the form of a crimping box equipped with a compaction chamber containing feed rollers, which cooperate with doctor blades. However, other forms of crimping machines or boxes are also possible.

Thus, the yarns that pass through the crimping machine or box 6 are given an initial crimp that they keep at the outlet of said crimping machine or box 6, to be deposited on the intermediate device 4 for accumulation and transport.

The deposit of the yarns 2' or 2" obtained, either directly at the outlet of the microtexturing machine 3 or in the form of crimped yarns at the outlet of the crimping machine or box 6 are deposited in bulk or in wraps on the intermediate device 4 for accumulation and transport.

For this purpose, the device 4 for accumulation and transport may be in the form of a reel, a conveyor belt or otherwise, whereby this device carries the yarns 2' or 2" without any impact on their tension, namely, in a free state. It results that said yarns 2' or 2" do not suffer any impact tending to modify their structure or appearance, before being transported into the heat treatment machine 5. The effect of microtexturing alone or the combined effect of microtexturing and crimping can, therefore, be exploited optimally, i.e. to obtain yarns 2' or 2" presenting maximum swelling and maximum crimping.

In particular embodiments, and according to a possible additional feature, the microtexturing operation consists of or comprises deforming the filaments of the yarn 2, so that they no longer extend in the direction of said yarn 2 and thus cause an increase in the diameter of said yarn 2. Indeed, the yarn 2 is generally composed of filaments or fibers, which essentially extend at their scale, in the same direction as the yarn 2, despite a possible helicoidal shape that can be given to these filaments, for example. The microtexturing stage then consists of or comprises distorting these filaments, so that they no longer reproduce the shape of the yarn 2 which they constitute, but present with a less linear shape, with loops or twists. Each filament then occupies more volume after microtexturing than before. The yarn 2, made up of these filaments arranged against each other, thus necessarily increases in volume, since the filaments that make them up occupy, after microtexturing, a larger volume, by the deformations made in them. Consequently, microtexturing has the effect of crimping the filaments constituting the yarn at their scale, without generating substantial deformation of the yarn 2.

In these embodiments, the microtexturing machine 3 is, therefore, a means capable of deforming the filaments constituting the yarn 2, so that they no longer extend in the direction of said yarn 2 and thus cause an increase in the diameter of the yarn 2. Advantageously, but not necessarily, the microtexturing machine 3 consists, essentially, of or comprises a texturing air nozzle capable of forming loops or twists in the filaments constituting the yarn 2.

The deformation of the filaments constituting the yarn 2, generated by microtexturing, therefore has the effect of increasing the diameter of the yarn 2 but also of changing the hand of the yarn 2, since its outer surface is defined by the filaments, which, at their scale, do not extend linearly, essentially reproducing the shape of the yarn 2, but which present with deformations, such as loops, waves or crimps.

Thus, the implementation of yarns obtained by the process according to the invention allows for substantial savings of yarns in the field of manufacturing of tufted carpets or rugs, the substantial increase in the section of the yarns following microtexturing, resulting in a much lower density of yarns per area unit. Further processing of crimping also allows affecting the final appearance of the carpets or rugs obtained.

Thanks to the invention, it is possible to produce a new type of synthetic yarns for the realization of tufted carpets and rugs, whose apparent volume is significantly increased compared to the initial volume of the yarn. In addition, the tactile aspect and visual appearance are also considerably modified compared to the original yarns.

Of course, the invention is not limited to the embodiments described and illustrated in the enclosed drawing. Modifications remain possible, particularly in terms of the constitution of the various elements or by substitution of technical equivalents, without departing from the scope of protection of the invention.

The invention claimed is:

1. A texturing process of yarns, upstream of a heat treatment unit, comprising:

making, downstream of a rack, on at least one of the yarns, at least one microtexturing operation that changes a texture of the at least one yarn and causes fibers of the at least one yarn to swell, depositing the at least one yarn obtained in bulk or in loops, in a free state, on an intermediate device for accumulation and transport, and carrying the at least one yarn obtained to a downstream heat treatment unit.

2. The process according to claim 1, further comprising a crimping operation of said at least one yarn in a crimping machine or crimping box before the yarn is deposited, in the free state, on the intermediate device for the accumulation and transport.

3. The process according to claim 1, wherein the microtexturing operation comprises deforming the fibers constituting the at least one yarn so that the fibers no longer extend in a direction of said at least one yarn and so that a diameter of the fibers increases.

4. The process according to claim 2, wherein the microtexturing operation comprises deforming the fibers constituting the at least one yarn so that fibers no longer extend in a direction of said at least one yarn and so that a diameter of the fibers increases.

5. A device for carrying out the process according to claim 1, comprising at least one microtexturing machine, mounted downstream of a rack and comprising an outlet that delivers the at least one yarn obtained, in the free state, onto the intermediate device for the accumulation and transport of the yarn to the downstream heat treatment unit.

6. The device according to claim 5, further comprising a crimping machine or box, inserted downstream of the microtexturing machine and upstream of the intermediate device for the accumulation and transport of the yarn or yarns to the downstream heat treatment unit.

7. The device according to claim 6, wherein the microtexturing machine is capable of deforming the fibers constituting the at least one yarn so that the fibers no longer extend in the direction of said at least one yarn and so that a diameter of the fibers increases.

8. The device according to claim 6, wherein the microtexturing machine is a texturing air nozzle capable of forming loops or twists in the fibers constituting the yarn.

9. The device according to claim 7, wherein the microtexturing machine is a texturing air nozzle capable of forming loops or twists in the fibers constituting the yarn.

10. A process for texturing yarns comprising:

microtexturing at least one yarn to deform filaments constituting the at least one yarn so that the filaments no longer extend in a longitudinal direction of the at least one yarn and so that a diameter of each of the filaments increases; and transporting the microtextured yarn in an untensioned state to a heat treatment unit.

11. The process of claim 10, further comprising crimping the yarns before transporting the yarns to the heat treatment unit.

12. The process of claim 10, further comprising delivering the yarn in its untensioned state to an intermediate device before transporting the yarn to the heat treatment unit.

13. The process of claim 11, wherein the yarn is crimped after the yarn has been microtextured.

14. The process of claim 10, wherein the step of microtexturing the yarn comprises forming loops or twists in the filaments of the yarn using a texturing air nozzle.

* * * * *